US009480331B2

(12) United States Patent
Tsai

(10) Patent No.: US 9,480,331 B2
(45) **Date of Patent: *Nov. 1, 2016**

(54) FOLDABLE TABLE

(71) Applicant: Ping-Cheng Tsai, Shenzhen (CN)

(72) Inventor: Ping-Cheng Tsai, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/743,992

(22) Filed: Jun. 18, 2015

(65) Prior Publication Data

US 2015/0282606 A1 Oct. 8, 2015

Related U.S. Application Data

(63) Continuation of application No. 14/507,797, filed on Oct. 6, 2014, now Pat. No. 9,089,204, which is a continuation of application No. 14/097,224, filed on Dec. 4, 2013, now Pat. No. 8,931,421, which is a continuation-in-part of application No. 13/694,182, filed on Nov. 1, 2012, now Pat. No. 8,677,912.

(51) Int. Cl.

| | |
|---|---|
| ***A47B 3/00*** | (2006.01) |
| ***A47B 3/08*** | (2006.01) |
| ***A47B 3/087*** | (2006.01) |
| ***A47B 3/091*** | (2006.01) |
| ***A47B 13/06*** | (2006.01) |
| *A47B 13/08* | (2006.01) |
| *A47B 3/083* | (2006.01) |

(52) U.S. Cl.

CPC ..... *A47B 3/0818* (2013.01); *A47B 3/083* (2013.01); *A47B 3/087* (2013.01); *A47B 3/0912* (2013.01); *A47B 13/06* (2013.01); *A47B 13/083* (2013.01); *A47B 2003/008* (2013.01); *A47B 2003/0821* (2013.01); *A47B 2003/0835* (2013.01); *Y10T 29/49826* (2015.01)

(58) Field of Classification Search

CPC ..... A47B 3/0912; A47B 3/091; A47B 3/00; A47B 3/08; A47B 3/0818

USPC ..... 108/132, 131, 133, 129, 115; 248/188.6

See application file for complete search history.

(56) References Cited

U.S. PATENT DOCUMENTS

| | | | | |
|---|---|---|---|---|
| 6,058,853 | A * | 5/2000 | Pinch | A47B 3/087 108/129 |
| 7,278,361 | B2 * | 10/2007 | Zhurong | A47B 3/0912 108/132 |
| 7,475,641 | B2 * | 1/2009 | Jin | A47B 3/087 108/132 |
| 7,634,969 | B2 * | 12/2009 | Neunzert | A47B 3/00 108/132 |
| 7,640,870 | B2 * | 1/2010 | Strong | A47B 3/087 108/129 |
| 8,225,725 | B2 * | 7/2012 | Voris | A47B 3/087 108/129 |

(Continued)

*Primary Examiner* — Jose V Chen

(74) *Attorney, Agent, or Firm* — Raymond Y. Chan; David and Raymond Patent Firm

(57) ABSTRACT

A method of folding up a table, which includes two tabletop panels, two leg frames foldably mounted at the tabletop panels respectively, and two connecting joints pivotally coupled between the tabletop panels respectively for enabling the tabletop panels to be pivotally folded between a folded condition and an unfolded condition, wherein a pivotal movable gap is formed at each of the connecting joints to enable a pivotal movement the tabletop panels to be pivotally folded between the folded condition and the unfolded condition, includes the steps of (a) pivotally folding the tabletop panels to the unfolded condition; and (b) locking up the pivotal movement between the tabletop panels in the unfolded condition for preventing a lateral movement of each of the connecting joints through the pivotal movable gap thereof.

19 Claims, 10 Drawing Sheets

(56) References Cited

U.S. PATENT DOCUMENTS 8,261,676 B2 * 9/2012 Vannimwegen ..... A47B 3/0912 108/125
8,677,912 B1 * 3/2014 Tsai ..... F16C 11/10 108/132
8,931,421 B2 * 1/2015 Tsai ..... A47B 3/087 108/132
9,089,204 B2 * 7/2015 Tsai ..... A47B 3/087
2002/0092445 A1 * 7/2002 Glover ..... A47B 3/087 108/129
2005/0061214 A1 * 3/2005 Tsai ..... A47B 3/087 108/132
2005/0155534 A1 * 7/2005 Lin ..... A47B 3/087 108/132
2008/0216719 A1 * 9/2008 Larcom ..... A47B 3/0815 108/132
2011/0017109 A1 * 1/2011 Stanford ..... A47B 3/091 108/132

* cited by examiner

FOLDABLE TABLE

CROSS REFERENCE OF RELATED APPLICATION

This is a Continuation application that claims the benefit of priority under 35 U.S.C. §119 to a non-provisional application, application Ser. No. 14/507,797, filed Oct. 6, 2014, which is a Continuation application that claims the benefit of priority under 35 U.S.C. §119 to a non-provisional application, application Ser. No. 14/097,224, filed Dec. 4, 2013, which is a Continuation-In-Part application that claims the benefit of priority under 35 U.S.C. §119 to a non-provisional application, application Ser. No. 13/694,182, filed Nov. 1, 2012, now U.S. Pat. No. 8,677,912.

BACKGROUND OF THE PRESENT INVENTION

1. Field of Invention

The present invention relates to a table, and more particularly to a foldable table which is equipped with a reinforcing frame for substantially strengthening a structural integrity of the foldable table, and a hinge arrangement for selectively and conveniently folding and unfolding a tabletop of the foldable table.

2. Description of Related Arts

A conventional foldable table usually comprises a tabletop and a supporting frame which comprises a tabletop reinforcing frame and a foldable leg frame connected thereunder in a pivotally foldable manner. When the foldable table is in use, the leg frame is pivotally unfolded and extended to support the tabletop at an elevated height, and when the foldable table is not in use, the leg frame is capable of being folded towards the tabletop for reduction in its overall size so as to facilitate easy storage and transportation.

Conventionally, most of the improvements for conventional foldable tables have been overwhelmingly concentrated on the leg frame. Persons skill in the art have devoted themselves in developing new kinds of leg frames and the foldable mechanism in order to make the foldable table easier to fold, more compact in size and more secure in structure.

On the other hand, however, it has been recognized that the tabletop may also be designed to reduce an overall size of the foldable table (e.g. by making the tabletop foldable). Although it is conceived that by altering the structure of the tabletop, the overall stability and security of the foldable table may be substantially deteriorated, this disadvantage should be carefully tackled so as to develop an optimal foldable table which is both compact in size and secure in structure.

SUMMARY OF THE PRESENT INVENTION

The invention is advantageous in that it provides a foldable table which is equipped with a reinforcing frame for substantially strengthening a structural integrity of the foldable table, and a hinge arrangement for selectively and conveniently folding and unfolding a tabletop of the foldable table.

Another advantage of the invention is to provide a foldable table which comprises a foldable frame which is capable of supporting a tabletop in a foldably movable manner without affecting the stability of the foldable table.

Another advantage of the invention is to provide a foldable table, wherein after the foldable table is moved at its unfolded condition, all the movable gaps thereof are minimized to enhance the rigidity and stabilization of the foldable table.

Another advantage of the invention is to provide a foldable table which comprises a hinge arrangement comprising a pivot pin pivotally connecting a two connecting joints for facilitating folding motions between two tabletop panels.

Another advantage of the invention is to provide a foldable table comprising a foldable frame which does not involve complicated and expensive mechanical components and processes so that the manufacturing cost of the present invention can be minimized.

Additional advantages and features of the invention will become apparent from the description which follows, and may be realized by means of the instrumentalities and combinations particular point out in the appended claims.

According to the present invention, the foregoing and other objects and advantages are attained by providing a foldable table, comprising:

a tabletop, which comprises:

a first tabletop panel;

a second tabletop panel;

a first peripheral edge rim downwardly and peripherally extended from the first tabletop panel to define a first receiving cavity within a bottom surface of the first tabletop panel and the first peripheral edge rim; and a second peripheral edge rim downwardly and peripherally extended from the second tabletop panel to define a second receiving cavity within a bottom surface of the second tabletop panel and the second peripheral edge rim; and a foldable frame, which comprises:

a reinforcing frame which comprises first through fourth elongated reinforcing member spacedly mounted along two longitudinal sides of the first receiving cavity and the second receiving cavity respectively;

a first and a second leg frame pivotally mounted on the first receiving cavity and the second receiving cavity respectively; and a hinge arrangement, which comprises:

a first connecting joint provided between inner ends of the first and third elongated reinforcing member respectively for allowing the first elongated reinforcing member and the third elongated reinforcing member to pivotally fold and unfold with respect to each other;

a second connecting joint provided between inner ends of the second and fourth elongated reinforcing member respectively for allowing the second elongated reinforcing member and the fourth elongated reinforcing member to pivotally fold and unfold with respect to each other; and a first and a second locker device coupled to the first connecting joint and the second connecting joint respectively, wherein the first locker device and the second locker device are arranged to operate between a locked position and an unlock position, wherein in the locked position, the first locker device and the second locker device are arranged to lock up pivotal movements of the first connecting joint and the second connecting joint, wherein in the unlocked position, the first locker device and the second locker device are arranged to unlock the pivotal movements of the first connecting joint and the second connecting joint so as to allow the first tabletop panel to fold and unfold with respect to the second tabletop panel.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
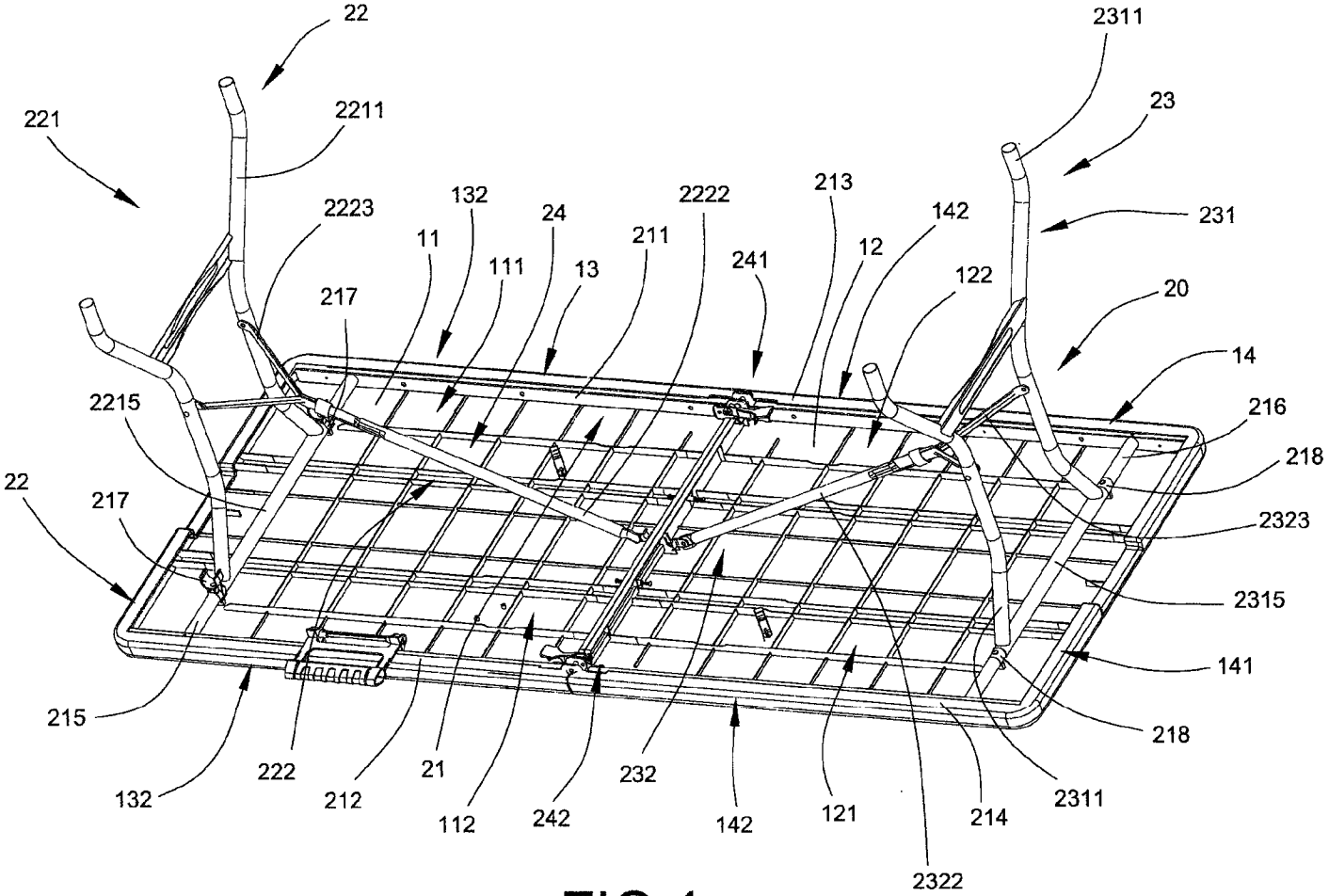
FIG. 1 is a perspective view of a foldable table according to a preferred embodiment of the present invention.

Referring to FIG. 1 to FIG. 7 of the drawings, a foldable table according to a preferred embodiment of the present invention is illustrated, in which the foldable table comprises a tabletop 10, and a foldable frame 20.

The tabletop 10 comprises a first tabletop panel 11, a second tabletop panel 12, a first peripheral edge rim 13 and a second peripheral edge rim 14. On the other hand, the foldable frame 20 comprises a reinforcing frame 21, a first leg frame 22, a second leg frame 23 and a hinge arrangement 24.

The first peripheral edge rim 13 is downwardly and integrally extended from the first tabletop panel 11 to define a first receiving cavity 111 within a bottom surface 112 of the first tabletop panel 11 and the first peripheral edge rim 13.

The second peripheral edge rim 14 is downwardly and integrally extended from the second tabletop panel 12 to define a second receiving cavity 121 within a bottom surface 122 of the second tabletop panel 12 and the second peripheral edge rim 14.

The reinforcing frame 21 comprises first through fourth elongated reinforcing member 211, 212, 213, 214 spacedly mounted along two longitudinal sides of the first receiving cavity 111 and the second receiving cavity 121 respectively.

The first and the second leg frame 22, 23 are pivotally mounted on the first receiving cavity 111 and the second receiving cavity 121 respectively. On the other hand, the hinge arrangement 24 comprises a first connecting joint 241, a second connecting joint 242, a first locker device 243, and a second locker device 244.

The first connecting joint 241 is provided between inner ends of the first and third elongated reinforcing member 211, 213 respectively for allowing the first elongated reinforcing member 211 and the third elongated reinforcing member 213 to pivotally fold and unfold with respect to each other.

Moreover, the second connecting joint 242 is provided between inner ends of the second and fourth elongated reinforcing member 212, 214 respectively for allowing the second elongated reinforcing member 212 and the fourth elongated reinforcing member 214 to pivotally fold and unfold with respect to each other.

On the other hand, the first and a second locker device 243, 244 are coupled to the first connecting joint 241 and the second connecting joint 242 respectively, wherein the first locker device 243 and the second locker device 244 are arranged to operate between a locked position and an unlock position, wherein in the locked position, the first locker device 243 and the second locker device 244 are arranged to lock up pivotal movements of the first connecting joint 241 and the second connecting joint 242, wherein in the unlocked position, the first locker device 243 and the second locker device 244 are arranged to unlock the pivotal movements of the first connecting joint 241 and the second connecting joint 242 so as to allow the first tabletop panel 11 to fold and unfold with respect to the second tabletop panel 12.

According to the preferred embodiment of the present invention, the first tabletop panel 11 and the second tabletop panel 12 are made of plastic material and are preferably formed by injection molding. Other manufacturing method is feasible but injection molding is the preferred mode of manufacturing method of the present invention. Moreover, each of the first tabletop panel 11 and the second tabletop panel 12 is rectangular in cross-sectional shape so that when they are foldably connected by the foldable frame 20, the entire foldable table has a rectangular cross sectional shape as well.

The first peripheral edge rim 13 and the second peripheral edge rim 14 are integrally extended from the first tabletop panel 11 and the second tabletop panel 12 respectively for forming the first receiving cavity 111 and the second receiving cavity 121. In this preferred embodiment, each of the first peripheral edge rim 13 and the second peripheral edge rim 14 is extended from a corresponding outer transverse edge and two longitudinal edges of the first tabletop panel 11 and the second tabletop panel 12 respectively. In other words, each of the first peripheral edge rim 13 and the second peripheral edge rim 14 form a U-shaped cross section with viewed from the bottom side of the foldable table.

Thus, the first peripheral rim 13 has a first transversely extending portion 131 and two first longitudinally extending portion 132, while second peripheral rim 14 has a second transversely extending portion 141 and two second longitudinally extending portion 142.

The first and the second elongated reinforcing member 211, 212 are extended along first longitudinally extending portions 132 of the first peripheral rim 13 respectively, while the third and the fourth elongated reinforcing member 213, 214 are extended along the longitudinally extending portions 142 of the second peripheral edge rim 14.

Figure 2:
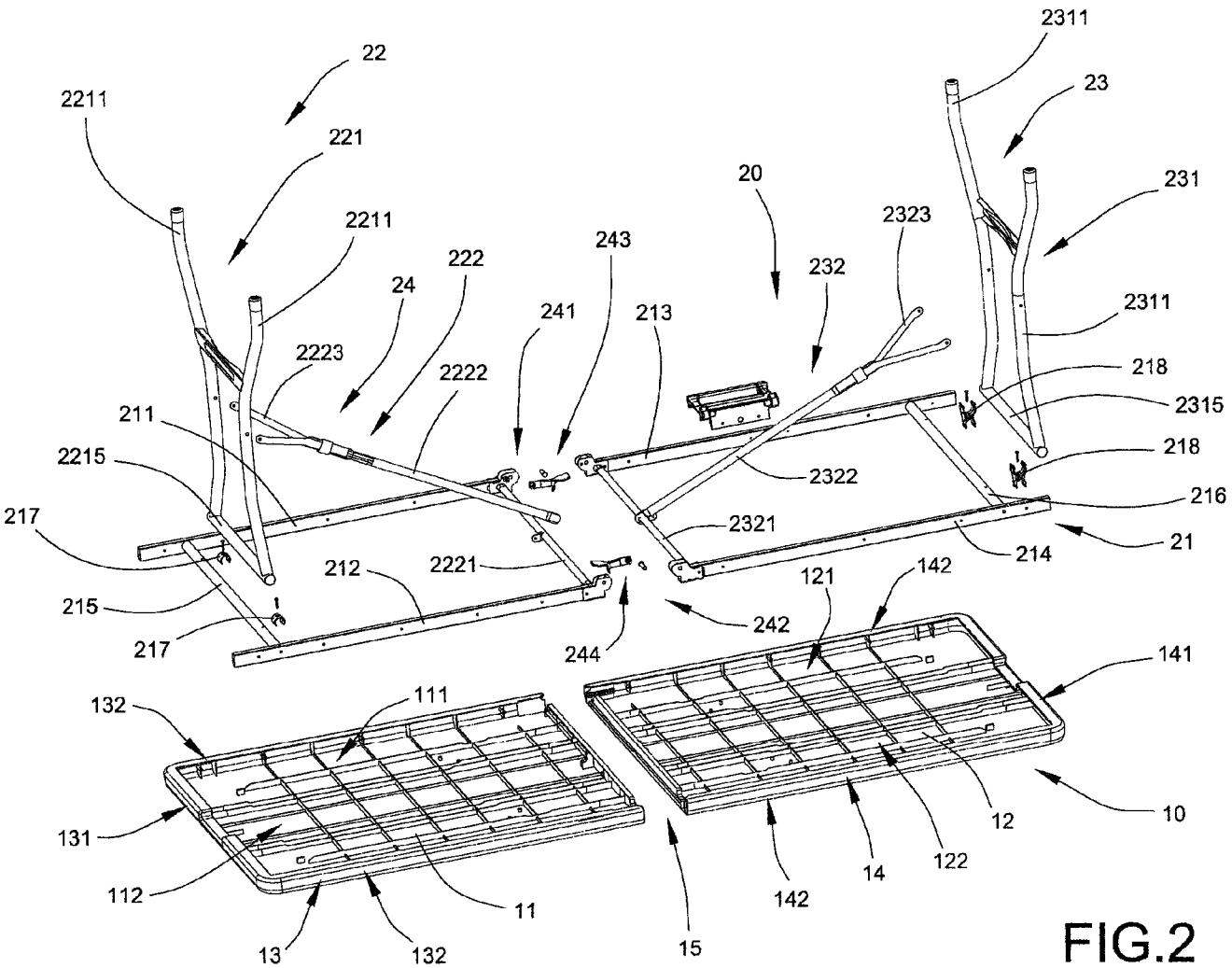
FIG. 2 is an exploded perspective view of the foldable table according to the above preferred embodiment of the present invention.
Figure 3:
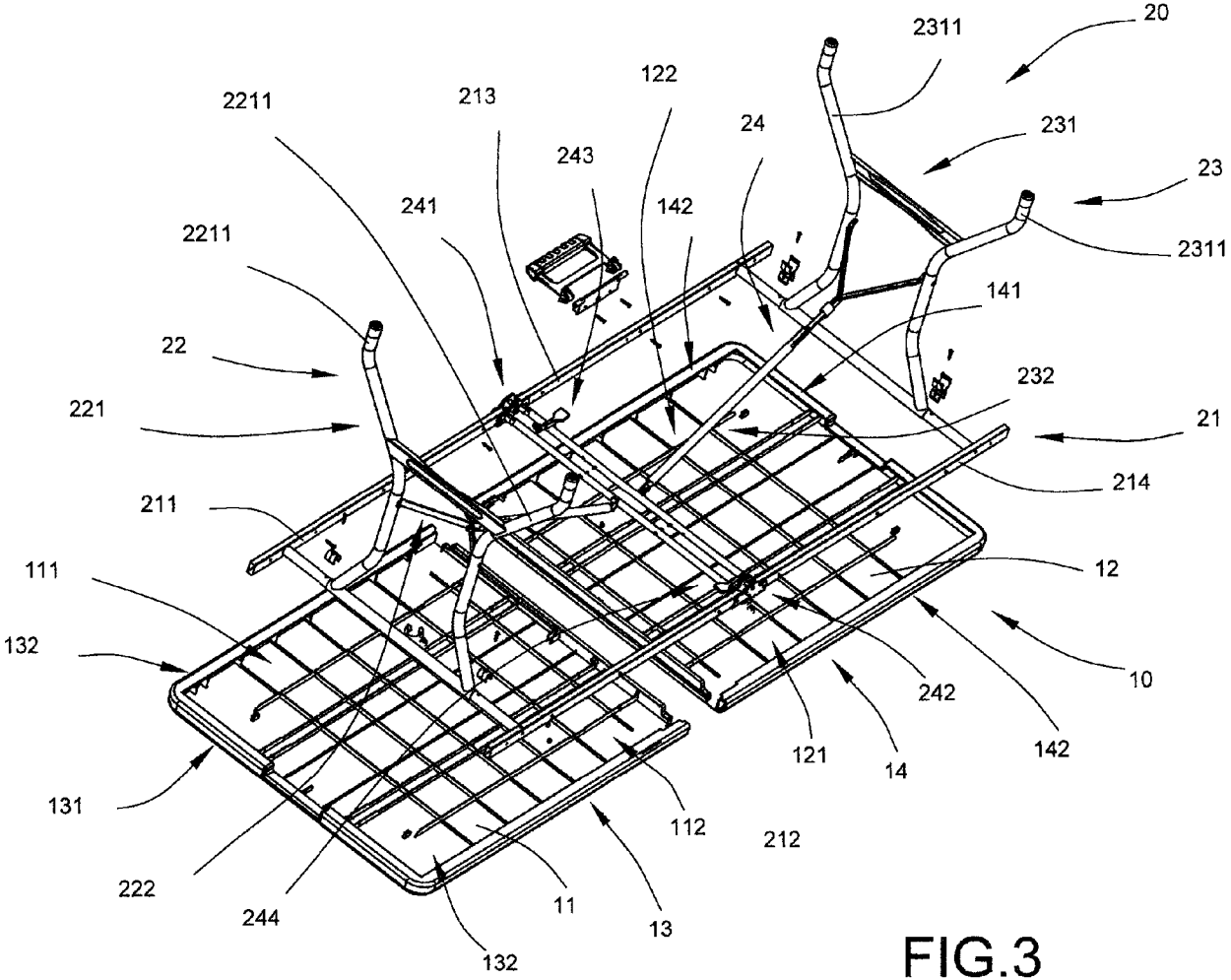
FIG. 3 is a schematic diagram of the foldable table according to the above preferred embodiment of the present invention.

The reinforcing frame 21 further comprises a first transverse member 215 transversely extended between the first and second reinforcing members 211, 212 at outer end portions thereof, and a second transverse member 216 transversely extended between the third and fourth reinforcing members 213, 214 at outer end portions thereof. As shown in FIG. 2, two ends of the first transverse member 215 are affixed to the first and second reinforcing members 211, 212, preferably be welding, to enhance the rigid support of the reinforcing frame 21 at the first tabletop panel 11 at the transverse side thereof. Likewise, two ends of the second transverse member 216 are affixed to the third and fourth reinforcing members 213, 214, preferably be welding, to enhance the rigid support of the reinforcing frame 21 at the second tabletop 12 at the transverse side thereof.

It is worth mentioning that the first transverse member 215 is non-rotatable with respect to the first and second reinforcing members 211, 212, and the second transverse member 216 is non-rotatable with respect to the third and fourth reinforcing members 213, 214. Since the first transverse member 215 is affixed to between first and second reinforcing members 211, 212, each of the first and second reinforcing members 211, 212 does not contain any hole for the end of the first transverse member 215 inserting into thereto. Likewise, since the second transverse member 216 is affixed to between third and fourth reinforcing members 213, 214, each of the third and fourth reinforcing members 213, 214 does not contain any hole for the end of the second transverse member 216 inserting into thereto. Any hole formed at each of the first to fourth reinforcing members 211, 212, 213, 214 will weaken the structure thereof. The foldable table will be wobbly due to the gap between the hole and the end of each of the first to fourth reinforcing members 211, 212, 213, 214.

On the other hand, the first leg frame 22 comprises a first supporting leg 221 having two first leg members 2211 pivotally connected to the first and the second elongated reinforcing member 211, 212, and a first connecting frame 222 foldably connected between the first tabletop panel 11 and the first supporting leg 221 in such a manner that the first supporting leg 221 is capable of selectively and pivotally folding toward and unfolding from the first tabletop panel 11 through the first connecting frame 222.

Similarly, the second leg frame 23 comprises a second supporting leg 231 having two second leg members 2311 pivotally connected to the third and the fourth elongated reinforcing member 213, 214, and a second connecting frame 232 foldably connected between the second tabletop panel 12 and the second supporting leg 231 in such a manner that the second supporting leg 231 is capable of selectively and pivotally folding toward and unfolding from the second tabletop panel 12 through the second connecting frame 232.

More specifically, the first connecting frame 222 comprises a first folding rod 2221 transversely extended between two inner end portions of the first reinforcing member 211 and the second reinforcing member 212 in the first receiving cavity 111, a first pivotal connecting shaft 2222 having one end pivotally extended from a mid portion of the first folding rod 2221, and a plurality of first elongated folding rods 2223 each having one end pivotally connected to the first leg members 2211 respectively, and another end pivotally coupled with another end of the first pivotal connecting shaft 2222. As shown in FIG. 1 of the drawings, when the elongated folding rods 2223 are pivotally folded with respect to the first pivotal connecting shaft 2222, the first supporting leg 221 is capable of folding and unfolding toward the first tabletop panel 11.

The second connecting frame 232 comprises a second folding rod 2321 transversely extended between two inner end portions of the third reinforcing member 213 and the fourth reinforcing member 214 in the second receiving cavity 121, a second pivotal connecting shaft 2322 having one end pivotally extended from a mid portion of the second folding rod 2321, and a plurality of second elongated folding rods 2323 each having one end pivotally connected to the second leg members 2311 respectively, and another end pivotally coupled with another end of the second pivotal connecting shaft 2322. Also as shown in FIG. 1 of the drawings, when the elongated folding rods 2323 are pivotally folded with respect to the second pivotal connecting shaft 2322, the second supporting leg 231 is capable of folding and unfolding toward the second tabletop panel 12.

As shown in FIGS. 1 and 2, the first supporting leg 221 further comprises a tubular first folding member 2215 coaxially coupled with the first transverse member 215 in a rotatably movable manner, wherein the first leg members 2211 are coupled at the first folding member 2215 to pivotally move between the first and second reinforcing members 211, 212 via the first transverse member 215. Accordingly, the first transverse member 215 is coaxially received in the first folding member 2215 to enable the rotational movement of the first folding member 2215 about the first transverse member 215. Therefore, when the first leg frame 22 is pivotally folded, the first transverse member 215 is stationary to rigidly support the transverse side of the first tabletop panel 11.

A length of the first folding member 2215 is shorter than a length of the first transverse member 215. In particular, the length of the first folding member 2215 is slightly longer than a distance between two upper ends of the first leg members 2211. Therefore, the pivot movement point of the first leg frame 21 is shifted closer to the longitudinal centerline of the first tabletop panel 11. Unlike the conventional leg structure, the folding leg is coupled at two longitudinal sides of the tabletop, such that the pivot movement point of the conventional folding leg is located at the two longitudinal sides of the tabletop.

Since the length of the first folding member 2215 is shorter than the length of the first transverse member 215, the first leg frame 22 may slide along the first transverse member 215. The reinforcing frame 21 further comprises two first retainers 217 affixed to the first transverse member 215 at two ends of the first folding member 2215 respectively to block the sliding movement of the first folding member 2215 with respect to the first transverse member 215. Accordingly, each of the first retainers 217 has a U-shaped cross section affixed to the first transverse member 215. The two ends of the first folding member 2215 are frictionally engaged with the first retainers 217 respectively. In particular, inner surfaces of the first retainers 217 are frictionally biased against outer circumferential surfaces of the first folding member 2215 at the two ends thereof when the first retainers 217 are affixed to the first transverse member 215. Therefore, the first folding member 2215 is pressed to the first transverse member 215 by the first retainers 217 to minimize the gap therebetween while the first folding member 2215 is still able to be rotated about the first transverse member 215 when the rotational force at the first folding member 2215 is larger than the frictional force at the first retainers 217. When the gap between the first folding member 2215 and the first transverse member 215 is minimized, the first leg frame 22 will press toward the first transverse member 215 to enhance the rigidity of the first tabletop panel 11 which is supported by the first leg frame 22, so as to prevent any unwanted wobbling movement thereof. Therefore, the first retainers 217 not only provides a blocking function to prevent the unwanted sliding movement of the first leg frame 22 but also minimize the gap between the first leg frame 22 and the first transverse member 215 to prevent the unwanted wobbling movement of the first tabletop panel 11.

It is worth mentioning that the first retainers 217 are also coupled at the bottom side of the first tabletop panel 11 through the first transverse member 215, through the screws of the first retainers 217, so as to lock up the first transverse member 215 at the bottom side of the first tabletop panel 11. As a result, the clearance between the first transverse member 215 and the bottom side of the first tabletop panel 11 will be minimized to enhance the support of the first tabletop panel 11 and to prevent the unwanted wobbling movement of the first tabletop panel 11.

Accordingly, in order to provide a rotatable movement, the diameter of the first folding member 2215 is larger than the diameter of the first transverse member 215, such that when the first transverse member 215 is coaxially received at the first folding member 2215, a rotatable movable gap is formed between the first transverse member 215 and the first folding member 2215 for enabling the rotatable movement of the first folding member 2215 in order to fold the first leg frame 22. If there is no rotatable movable gap, the first folding member 2215 cannot be rotated about the first transverse member 215.

Figure 10:
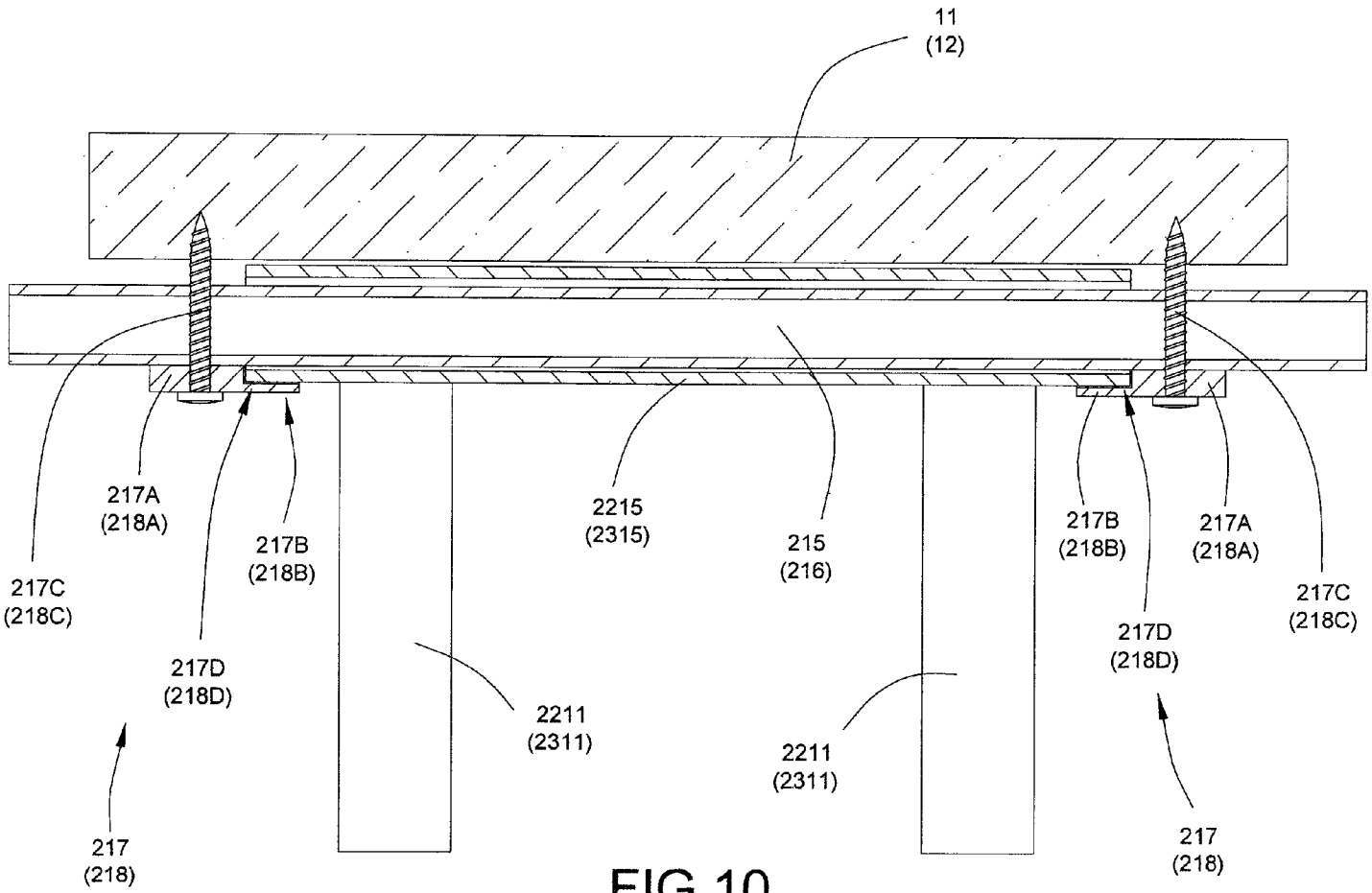
FIG. 10 is a sectional view of the retainer coupling at the transverse member of the foldable table according to the above preferred embodiment of the present invention.

As shown in FIG. 10, each of the first retainers 217 has a thicken portion 217A and a thin portion 217B, wherein a thickness of the thick portion 217A is thicker than that of the thin portion 217B. The thicken portion 217A is affixed to the first transverse member 215 via the screw 217C while the thin portion 217B is frictionally engaged with the first folding member 2215 at the corresponding end thereof. Each of the first retainers 217 further has a side slot 217D formed at a sidewall of the thicken portion 217A to face toward the thin portion 217B, wherein the end of the first folding member 2215 is received at the side slot 217D to retain the first folding member 2215 in position. In other words, the two ends of the first folding member 2215 are received at the side slots 217D and are frictionally engaged with the thin portions 217B of the first retainers 217. Therefore, any sliding movement of the first folding member 2215 along the first transverse member 215 is prohibited. However, the first folding member 2215 is still able to be rotated about the first transverse member 215 when the rotational force at the first folding member 2215 is larger than the frictional force at the first retainers 217. In other words, the rotatable movable gap will be minimized by the first retainers 217 to prevent any unwanted movement of the first folding member 2215 except the rotatable movement thereof.

As shown in FIGS. 1 and 2, the second supporting leg 231 further comprises a tubular second folding member 2315 coaxially coupled with the second transverse member 216 in a rotatably movable manner, wherein the second leg members 2311 are coupled at the second folding member 2315 to pivotally move between the third and fourth reinforcing members 213, 214 via the second transverse member 216. Accordingly, the second transverse member 216 is coaxially received in the second folding member 2315 to enable the rotational movement of the second folding member 2315 about the second transverse member 216. Therefore, when the second leg frame 23 is pivotally folded, the second transverse member 216 is stationary to rigidly support the transverse side of the second tabletop panel 12.

A length of the second folding member 2315 is shorter than a length of the second transverse member 216. In particular, the length of the second folding member 2315 is slightly longer than a distance between two upper ends of the second leg members 2311. Therefore, the pivot movement point of the second leg frame 23 is shifted closer to the longitudinal centerline of the second tabletop panel 12. Unlike the conventional leg structure, the folding leg is coupled at two longitudinal sides of the tabletop, such that the pivot movement point of the conventional folding leg is located at the two longitudinal sides of the tabletop.

Since the length of the second folding member 2315 is shorter than the length of the second transverse member 216, the second leg frame 23 may slide along second first transverse member 216. The reinforcing frame 21 further comprises two second retainers 218 affixed to the second transverse member 216 at two ends of the second folding member 2315 respectively to block the sliding movement of the second folding member 2315 with respect to the second transverse member 216. Accordingly, each of the second retainers 218 has a U-shaped cross section affixed to the second transverse member 216. The two ends of the second folding member 2315 are frictionally engaged with the second retainers 218 respectively. In particular, inner surfaces of the second retainers 218 are frictionally biased against outer circumferential surfaces of the second folding member 2315 at the two ends thereof when the second retainers 218 are affixed to the second transverse member 216. Therefore, the second folding member 2315 is pressed to the second transverse member 216 by the second retainers 218 to minimize the gap therebetween while the second folding member 2315 is still able to be rotated about the second transverse member 216 when the rotational force at the first folding member 2215 is larger than the frictional force at the second retainers 218. When the gap between the second folding member 2315 and the second transverse member 216 is minimized, the second leg frame 23 will press toward the second transverse member 216 to enhance the rigidity of the second tabletop panel 12 which is supported by the second leg frame 23, so as to prevent any unwanted wobbling movement thereof. Therefore, the second retainers 218 not only provides a blocking function to prevent the unwanted sliding movement of the second leg frame 23 but also minimize the gap between the second leg frame 23 and the second transverse member 216 to prevent the unwanted wobbling movement of the second tabletop panel 12.

It is worth mentioning that the second retainers 218 are also coupled at the bottom side of the second tabletop panel 12 through the second transverse member 216, through the screws of the second retainers 218, so as to lock up the second transverse member 216 at the bottom side of the second tabletop panel 12. As a result, the clearance between the second transverse member 216 and the bottom side of the second tabletop panel 12 will be minimized to enhance the support of the second tabletop panel 12 and to prevent the unwanted wobbling movement of the second tabletop panel 12.

It is worth mentioning that the first and second transverse member 215, 216 are symmetrical and the first and second folding members 2215, 2315 are symmetrical. The first and second retainers 217, 218 are also symmetrical.

Accordingly, in order to provide a rotatable movement, the diameter of the second folding member 2315 is larger than the diameter of the second transverse member 216, such that when the second transverse member 216 is coaxially received at the second folding member 2315, another rotatable movable gap is formed between the second transverse member 216 and the second folding member 2315 for enabling the rotatable movement of the second folding member 2315 in order to fold the second leg frame 23. If there is no rotatable movable gap, the second folding member 2315 cannot be rotated about the second transverse member 216.

As shown in FIG. 10, each of the second retainers 218 has a thicken portion 218A and a thin portion 218B, wherein a thickness of the thick portion 218A is thicker than that of the thin portion 218B. The thicken portion 218A is affixed to the second transverse member 216 via the screw 218C while the thin portion 218B is frictionally engaged with the second folding member 2315 at the corresponding end thereof. Each of the second retainers 218 further has a side slot 218D formed at a sidewall of the thicken portion 218A to face toward the thin portion 218B, wherein the end of the second folding member 2315 is received at the side slot 218D to retain the second folding member 2315 in position. In other words, the two ends of the second folding member 2315 are received at the side slots 218D and are frictionally engaged with the thin portions 218B of the second retainers 218. Therefore, any sliding movement of the second folding member 2315 along the second transverse member 216 is prohibited. However, the second folding member 2315 is still able to be rotated about the second transverse member 216 when the rotational force at the second folding member 2315 is larger than the frictional force at the second retainers 218. In other words, the rotatable movable gap will be minimized by the second retainers 218 to prevent any unwanted movement of the second folding member 2315 except the rotatable movement thereof.

In other words, the first connecting frame 222 and the second connecting frame 232 are capable of facilitating folding and unfolding of the first leg frame 22 and the second leg frame 23. When the first leg frame 22 and the second leg frame 23 are folded toward the first and the second tabletop panel 11, 12, the entire foldable table can be reduced to a compact size.

Figure 4:
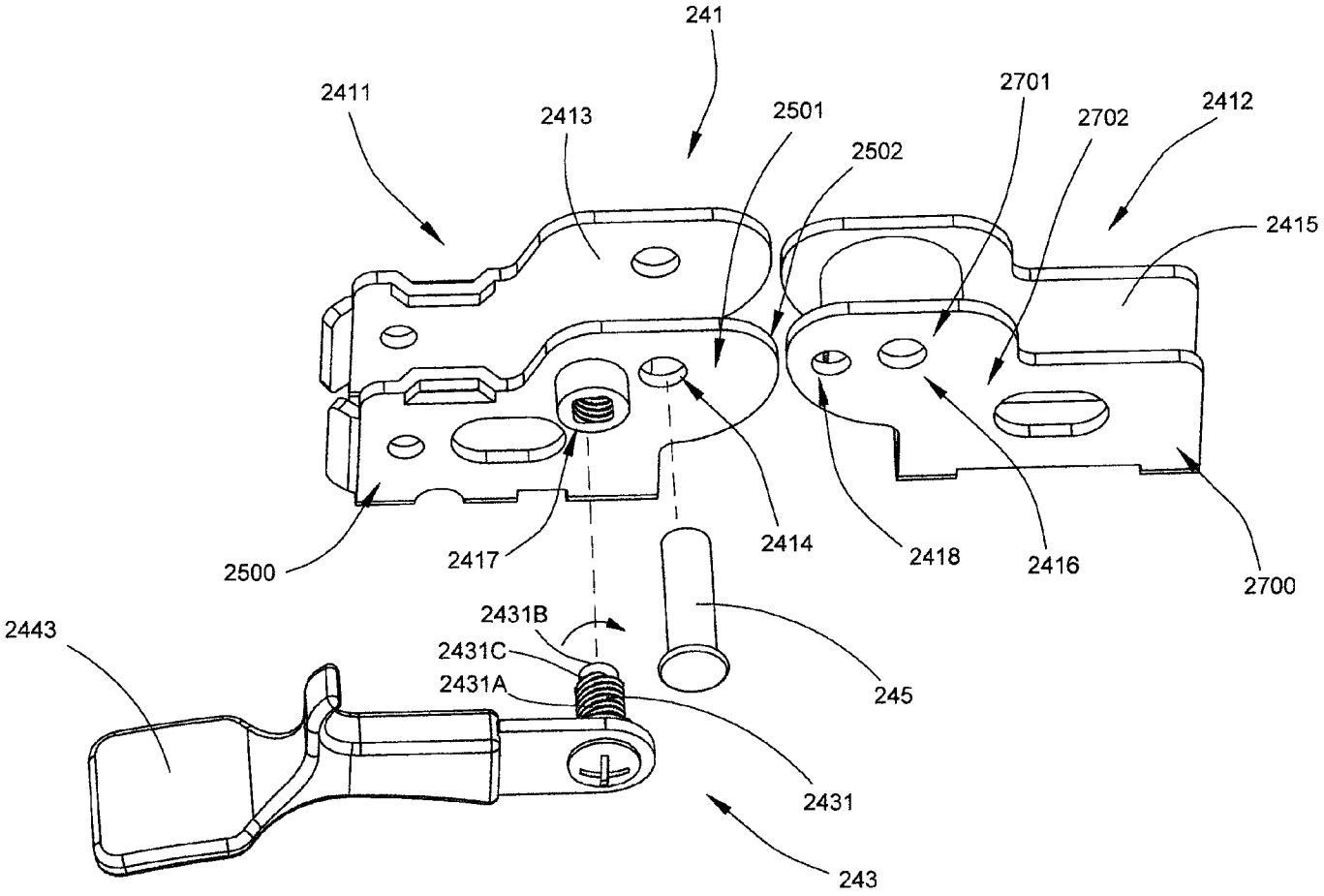
FIG. 4 is a perspective view of a connecting joint of the foldable table according to the above preferred embodiment of the present invention.
Figure 5:
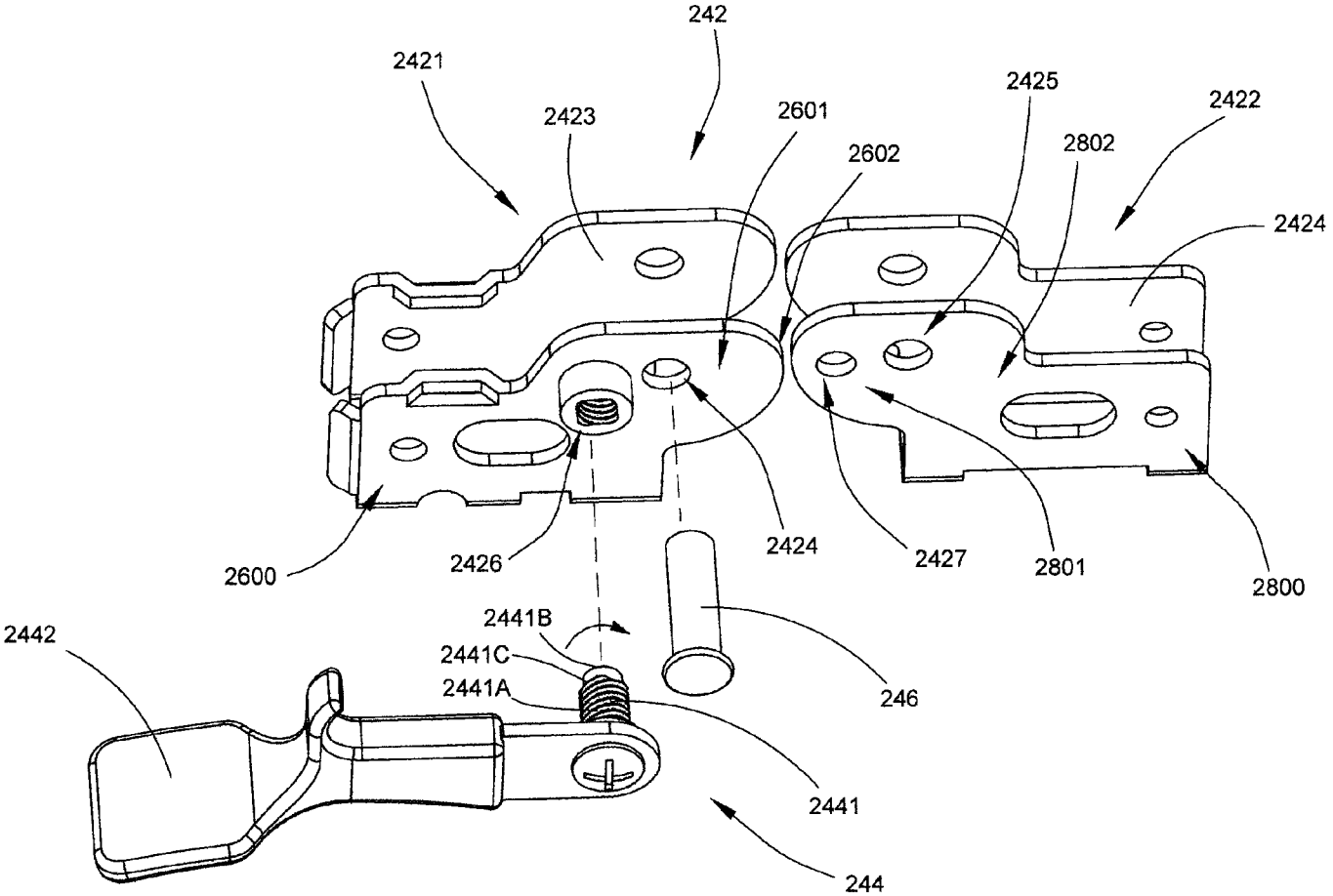
FIG. 5 is an exploded perspective view of the connecting joint of the foldable table according to the above preferred embodiment of the present invention.
Figure 6:
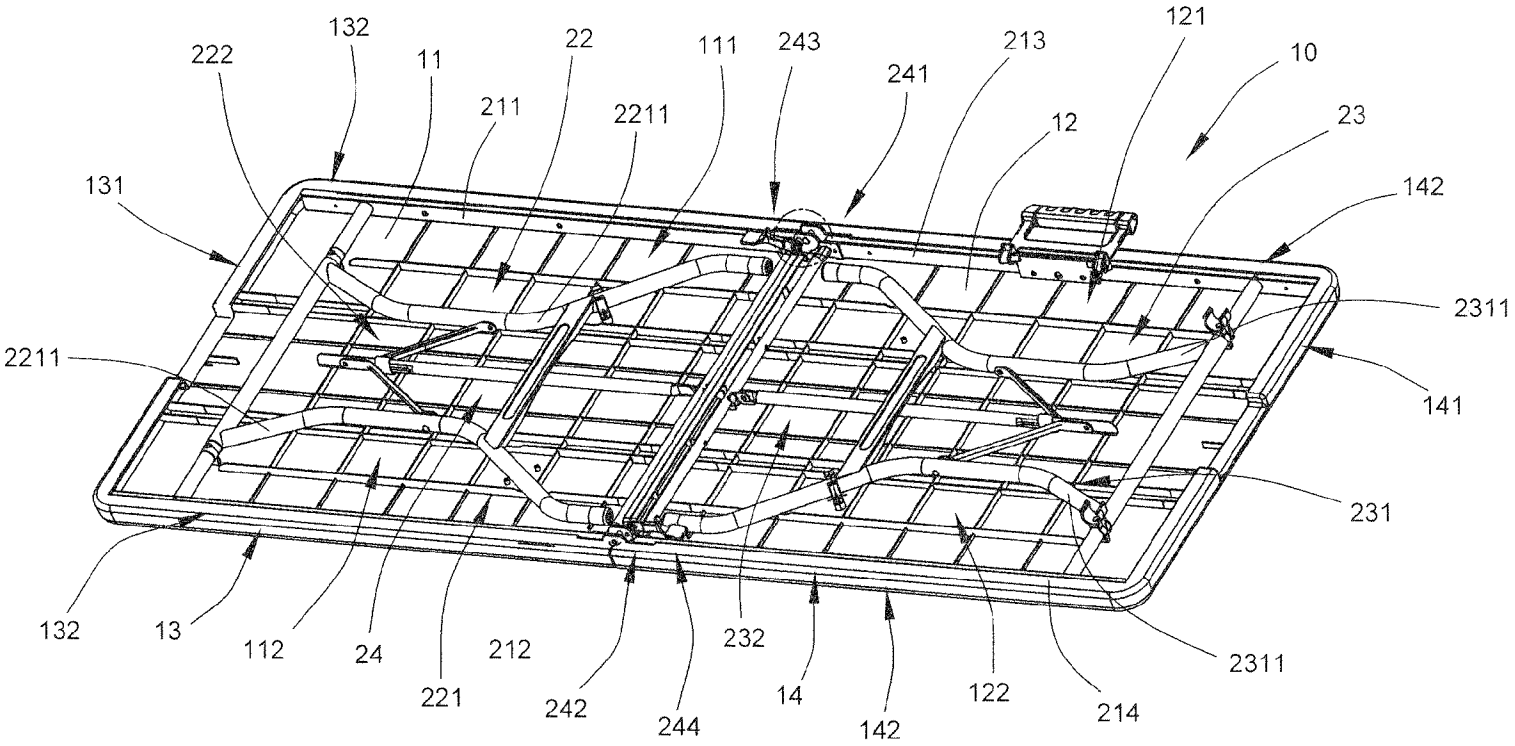
FIG. 6 is a perspective view of the foldable table according to the above preferred embodiment of the present invention, illustrating one of the locker devices.
Figure 7:
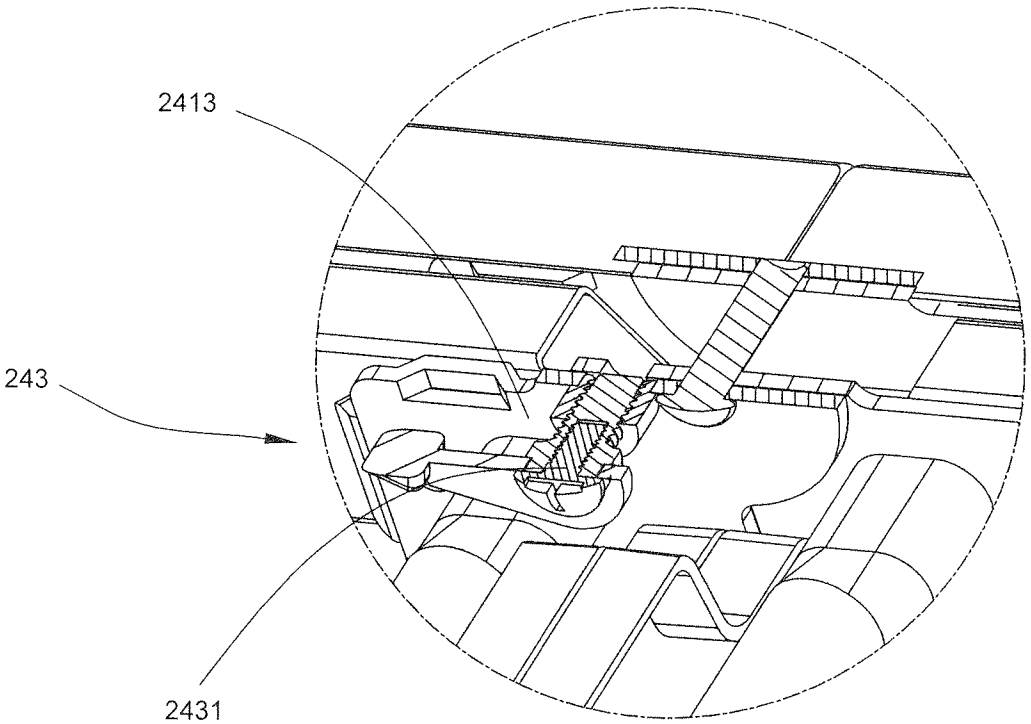
FIG. 7 is a schematic diagram of one of the locker devices according to the above preferred embodiment of the present invention.

Referring to FIG. 4 to FIG. 5 of the drawings, the hinge arrangement 24 comprises the first connecting joint 241, the second connecting joint 242, the first locker device 243, and the second locker device 244. According to the preferred embodiment of the present invention, the first connecting joint 241 comprises a first joint member 2411 and a third joint member 2412 coupled to the inner end of the first elongated reinforcing member 211 and the third elongated reinforcing member 213 respectively. The first joint member 2411 comprises a plurality of first connecting panels 2413 spacedly mounted to the first elongated reinforcing member 211, wherein each of the first connecting panels 2413 has a first pivot hole 2414 alignedly formed thereon. Moreover, the hinge arrangement 24 further comprises a first pivot pin 245 arranged to penetrate the first pivot holes 2414 formed on the first connecting panels 2413.

On the other hand, the third joint member 2412 is coupled to the inner end of the third elongated reinforcing member 213. The third joint member 2412 comprises a plurality of third connecting panels 2415 spacedly mounted to the third elongated reinforcing member 213, wherein each of the third connecting panels 2415 has a third pivot hole 2416 alignedly formed thereon. As shown in FIG. 4 of the drawings, the first connecting panels 2413 are arranged to overlap with the third connecting panels 2415 at the space formed between the first connecting panels 2413 and the third connecting panels 2415, wherein the first pivot pin 245 is arranged to penetrate the first pivot holes 2414 and the third pivot holes 2416 so that the first joint member 2411 and the third joint member 2413 can be pivotally folded and unfolded with respect to each other.

Similarly, as shown in FIG. 5 of the drawings, the second connecting joint 242 comprises a second joint member 2421 and a fourth joint member 2422 coupled to the inner end of the second elongated reinforcing member 212 and the fourth elongated reinforcing member 214 respectively. The second joint member 2421 comprises a plurality of second connecting panels 2423 spacedly mounted to the second elongated reinforcing member 212, wherein each of the second connecting panels 2423 has a second pivot hole 2424 alignedly formed thereon. Moreover, the hinge arrangement 24 further comprises a second pivot pin 246 arranged to penetrate the second pivot holes 2424 formed on the second connecting panels 2423.

On the other hand, the fourth joint member 2422 is coupled to the inner end of the fourth elongated reinforcing member 214. The fourth joint member 2422 comprises a plurality of fourth connecting panels 2424 spacedly mounted to the fourth elongated reinforcing member 214, wherein each of the fourth connecting panels 2422 has a fourth pivot hole 2425 alignedly formed thereon. As shown in FIG. 5 of the drawings, the second connecting panels 2423 are arranged to overlap with the fourth connecting panels 2424 at the space formed between the second connecting panels 2423 and the fourth connecting panels 2422, wherein the second pivot pin 246 is arranged to penetrate the second pivot holes 2424 and the fourth pivot holes 2425 so that the second joint member 2421 and the fourth joint member 2422 can be pivotally folded and unfolded with respect to each other.

It is worth mentioning that the first pivot pin 245 and the second pivot pin 246 are rigid and may be embodied as having a wide variety of cross sectional shapes so as to ensure sound stability of the hinge arrangement 24. Moreover, the first pivot pin 245 and the second pivot pin 246 can be made of a wide variety of materials so as to accommodate different manufacturing and marketing needs.

According to the preferred embodiment, two ends of the first folding rod 2221 are affixed to the first and second joint members 2411, 2421 respectively. In particular, one end of the first folding rod 2221 is affixed to the first connecting panel 2413 at an inner position of the first joint member 2411 while an opposed end of the first folding rod 2221 is affixed to the second connecting panel 2423 at an inner position of the second joint member 2421. Two ends of the second folding rod 2321 are affixed to the third and fourth joint members 2412, 2422 respectively. In particular, one end of the second folding rod 2321 are affixed to the third connecting panel 2415 at an inner position of the third joint member 2422 and an opposed end of second folding rod 2321 is affixed to the fourth connecting panel 2424 at an inner position of the fourth joint member 2422. Accordingly, the first folding rod 2221 is non-rotatable between the first and second joint members 2411, 2421 while the second folding rod 2321 is non-rotatable between third and fourth joint members 2412, 2422.

Therefore, no hole is formed at the inner end portions of the first, second, third and fourth reinforcing members 211, 212, 213, 214 in order to connect to the first and second folding rods 2221, 2321 so as to enhance the rigidity of the reinforcing frame 21.

Each of the first connecting panels 2413 has a first base portion 2500 coupled to the first elongated reinforcing member 211 and a first head portion 2501 upwardly and inwardly extended from the first base portion 2500, wherein the first pivot hole 2414 is formed on the first head portion 2502. Similarly, each of the third connecting panels 2415 has a third base portion 2700 coupled to the third elongated reinforcing member 213 and a third head portion 2701 upwardly and inwardly extended from the third base portion 2500, wherein the third pivot hole 2416 is formed on the third head portion 2701.

Each of the second connecting panels 2423 has a second base portion 2600 coupled to the second elongated reinforcing member 212 and a second head portion 2601 upwardly and inwardly extended from the second base portion 2600, wherein the second pivot hole 2424 is formed on the second head portion 2601. Finally, each of the fourth connecting panels 2424 has a fourth base portion 2800 coupled to the fourth elongated reinforcing member 214 and a fourth head portion 2801 upwardly and inwardly extended from the fourth base portion 2800, wherein the fourth pivot hole 2425 is formed on the fourth head portion 2801.

From the forgoing descriptions, it can be shown that the first tabletop panel 11 and the second tabletop panel 12 can be selectively folded and unfolded through hinge arrangement 24 of the foldable frame 20. Moreover, as mentioned earlier, the first leg frame 22 and the second leg frame 23 can also be folded and unfolded with respect to the first tabletop panel 11 and the second tabletop panel 12 respectively.

Referring to FIG. 4 to FIG. 7 of the drawings, the first locker device 243 comprises a first locker pin 2431 and a first locker handle 2432 extended from the first locker pin 2431, wherein the first locker pin 2431 is arranged to selectively penetrate one of the first connecting panels 2413 and the corresponding third connecting panel 2415 for restricting the relative pivotal movement between the corresponding first joint member 2411 and the third joint member 2412. Accordingly, the first joint member 2411 further has a first locker hole 2417 formed on one of the first connecting panels 2413 while the third joint member 2412 further has a third locker hole 2418 formed on the corresponding third connecting panel 2415, wherein the first locker hole 2417 and the third locker hole 2418 are aligned with each other so that the first locker pin 2431 is arranged to rotatably penetrate the first locker hole 2417 and the third locker hole 2418 for selectively locking the first joint member 2411 and the third joint member 2412. Note that the rotational movement of the first locker pin 2431 is actuated by a movement of the locker handle 2432.

Accordingly, the first locker hole 2417 and the third locker hole 2418 are two circular holes and are aligned with each other when the first and second tabletop panels 11, 12 are pivotally folded in the unfolded condition. In other words, when the first and second tabletop panels 11, 12 are pivotally folded in the folded condition, the first locker hole 2417 is misaligned with the third locker hole 2418. As shown in FIG. 4, the first locker pin 2431 has a first thread portion 2431A and a first free end portion 2431B having a diameter smaller than that of the first thread portion 2431A, and defines a first neck platform 2431C between the first thread portion 2431A and the first free end portion 2431B. The first thread portion 2431A of the first locker pin 2431 is rotatably coupled with the first locker hole 2417 which is a threaded hole. The length of the first thread portion of the first locker pin 2431 is longer than the length of the first locker hole 2417. The third locker hole 2418 has a diameter matching with the diameter of the first free end portion 2431B of the first locker pin 2431. In other words, the diameter of the first locker hole 2417 is larger than the diameter of the third locker hole 2418. When the first locker pin 2431 is rotated to rotatably engage with the first locker hole 2417, the first free end portion 2431B of the first locker pin 2431 is aligned to be inserted into the third locker hole 2418. Once the first free end portion 2431B of the first locker pin 2431 is inserted into the third locker hole 2418, the first joint member 2411 and the third joint member 2412 are locked up with each other. When the first locker pin 2431 is rotated at an opposed direction, the first free end portion 2431B of the first locker pin 2431 is disengaged with the third locker hole 2418, i.e. the first free end portion 2431B of the first locker pin 2431 is moved away from the third locker hole 2418. Therefore, the first joint member 2411 and the third joint member 2412 are unlocked to enable the pivotal movement between the first joint member 2411 and the third joint member 2412.

It is worth mentioning that the first connecting panels 2413 and the third connecting panels 2415 are parallel and overlapped with each other, wherein the first connecting panels 2413 and the third connecting panels 2415 are pivotally coupled via the first pivot pin 245. In particular, the first head portion 2501 of the first connecting panel 2413 is spacedly overlapped with the third head portion 2701 of the third connecting panel 2415 to define a clearance or gap therebetween, wherein the first head portion 2501 of the first connecting panel 2413 is pivotally coupled with the third head portion 2701 of the third connecting panel 2415 via the first pivot pin 245. In view of the first connecting joint 2411, the first pivot pin 245 is located between the first locker hole 2417 and a first free edge 2502. In view of the third connecting joint 2412, the first pivot pin 245 is located between the third locker hole 2418 and a third neck portion 2702 which is a portion between the third head portion 2701 and the third base portion 2700.

After the first free end portion 2431B of the first locker pin 2431 is inserted into the third locker hole 2418, the first locker pin 2431 is kept rotating until the first neck platform 2431C is biased against the corresponding third connecting panel 2415. As a result, a portion of the third connecting panel 2415, i.e. the third head portion 2701, around the third locker hole 2418 is pressed away from the corresponding first connecting panel 2413. Due to the pivot movement of the third connecting panel 2415 at the pivot point of the first pivot pin 245, an opposed portion of the third connecting panel 2415, i.e. the third neck portion 2702, is pivotally moved to press against the corresponding first connecting panel 2413 at the first free edge 2502 thereof. Therefore, a gap between the first and third connecting panels 2413, 2415 will be minimized. Accordingly, when the first connecting panels 2413 and the third connecting panels 2415 are parallel with each other, the gap will be formed between the first and third connecting panels 2413, 2415 without contacting with each other. When the loading force is applied on the tabletop 10, the loading force will be concentrated at the first pivot pin 245 which may damage the first pivot pin 245 and may cause the foldable table unstable. The foldable table will be wobbly due to the gap. When the gap between the first and third connecting panels 2413, 2415 is minimized, the first and third connecting panels 2413, 2415 will press with each other to enhance the rigidity of the reinforcing frame 21 especially to reinforce the connection between the inner ends of the first and third elongated reinforcing members 211, 213. Furthermore, when the loading force is applied on the tabletop 10, the loading force will be evenly distributed along the first and third elongated reinforcing member 211, 213 via the first and third connecting panels 2413, 2415, such that the foldable table will be stable to prevent any unwanted wobbling movement thereof. It is worth mentioning that the neck platform is biased against the corresponding third connecting panel 2415 to substantially retain the gap distance between the first and third connecting panels 2413, 2415 so as to prevent the unwanted relative movement between the first and third connecting panels 2413, 2415.

On the other hand, the second locker device 244 comprises a second locker pin 2441 and a second locker handle 2442 extended from the second locker pin 2441, wherein the second locker pin 2441 is arranged to selectively penetrate one of the second connecting panels 2423 and the corresponding fourth connecting panel 2424 for restricting the relative pivotal movement between the corresponding second joint member 2421 and the fourth joint member 2422. Accordingly, the second joint member 2421 further has a second locker hole 2426 formed on one of the second connecting panels 2423 while the fourth joint member 2422 further has a fourth locker hole 2427 formed on the corresponding fourth connecting panel 2424, wherein the second locker hole 2426 and the fourth locker hole 2427 are aligned with each other so that the second locker pin 2441 is arranged to rotatably penetrate the second locker hole 2426 and the fourth locker hole 2427 for selectively locking the second joint member 2421 and the fourth joint member 2422. Note that the rotational movement of the second locker pin 2441 is actuated by a movement of the second locker handle 2442.

Similarly, the second locker hole 2426 and the fourth locker hole 2427 are two circular holes and are aligned with each other when the first and second tabletop panels 11, 12 are pivotally folded in the unfolded condition. In other words, when the first and second tabletop panels 11, 12 are pivotally folded in the folded condition, the second locker hole 2426 is misaligned with the fourth locker hole 2427. As shown in FIG. 5, the second locker pin 2441 has a second thread portion 2441A and a second free end portion 2441B having a diameter smaller than that of the second thread portion 2441A, and defines a second neck platform 2441C between the second thread portion 2441A of the second free end portion 2441B. The second thread portion 2441A of the second locker pin 2441 is rotatably coupled with the second locker hole 2426 which is a threaded hole. The length of the second thread portion 2441A of the second locker pin 2441 is longer than the length of the second locker hole 2426. The fourth locker hole 2427 has a diameter matching with the diameter of the second free end portion 2441B of the second locker pin 2441. In other words, the diameter of the second locker hole 2426 is larger than the diameter of the fourth locker hole 2427. When the second locker pin 2441 is rotated to rotatably engage with the second locker hole 2426, the second free end portion 2441B of the second locker pin 2441 is aligned to be inserted into the fourth locker hole 2427. Once the free end portion 2441B of the second locker pin 2441 is inserted into the fourth locker hole 2427, the second joint member 2421 and the fourth joint member 2422 are locked up with each other. When the second locker pin 2441 is rotated at an opposed direction, the second free end portion 2441B of the second locker pin 2441 is disengaged with the fourth locker hole 2427, i.e. the second free end portion 2441B of the second locker pin 2441 is moved away from the fourth locker hole 2427. Therefore, the second joint member 2421 and the fourth joint member 2422 are unlocked to enable the pivotal movement between the second joint member 2421 and the fourth joint member 2422.

It is worth mentioning that the second connecting panels 2423 and the fourth connecting panels 2424 are parallel and overlapped with each other, wherein the second connecting panels 2423 and the fourth connecting panels 2424 are pivotally coupled via the second pivot pin 246. In particular, the second head portion 2601 of the second connecting panel 2423 is spacedly overlapped with the fourth head portion 2801 of the fourth connecting panel 2424 to define a clearance or gap therebetween, wherein the second head portion 2601 of the second connecting panel 2423 is pivotally coupled with the fourth head portion 2801 of the fourth connecting panel 2424 via the second pivot pin 246. In view of the second connecting joint 2421, the second pivot pin 246 is located between the second locker hole 2426 and a second free edge 2602. In view of the fourth connecting joint 2422, the second pivot pin 246 is located between the fourth locker hole 2427 and a fourth neck portion 2802 which is a portion between the fourth head portion 2801 and the fourth base portion 2800.

After the free end portion 2441B of the second locker pin 2441 is inserted into the fourth locker hole 2427, the second locker pin 2441 is kept rotating until the second neck platform 2441C is biased against the corresponding fourth connecting panel 2424. As a result, a portion of the fourth connecting panel 2424, i.e. the fourth head portion 2801, around the fourth locker hole 2427 is pressed away from the corresponding second connecting panel 2423. Due to the pivot movement of the fourth connecting panel 2424 at the pivot point of the second pivot pin 246, an opposed portion of the fourth connecting panel 2424, i.e. the neck portion 2802, is pivotally moved to press against the corresponding second connecting panel 2423 at the second free edge 2602 thereof. Therefore, a gap between the second and fourth connecting panels 2423, 2424 will be minimized. Accordingly, when the second connecting panels 2423 and the fourth connecting panels 2424 are parallel with each other, the gap will be formed between the second and fourth connecting panels 2423, 2424 without contacting with each other. When the loading force is applied on the tabletop 10, the loading force will be concentrated at the second pivot pin 246 which may damage the second pivot pin 246 and may cause the foldable table unstable. The foldable table will be wobbly due to the gap. When the gap between the second and fourth connecting panels 2423, 2424 is minimized, the second and fourth connecting panels 2423, 2424 will press with each other to enhance the rigidity of the reinforcing frame 21 especially to reinforce the connection between the inner ends of the second and fourth elongated reinforcing members 212, 214. Furthermore, when the loading force is applied on the tabletop 10, the loading force will be evenly distributed along the second and fourth elongated reinforcing members 212, 214 via the second and fourth connecting panels 2423, 2424, such that the foldable table will be stable to prevent any unwanted wobbling movement thereof. It is worth mentioning that the neck platform is biased against the corresponding fourth connecting panel 2424 to substantially retain the gap distance between the second and fourth connecting panels 2423, 2424 so as to prevent the unwanted relative movement between the second and fourth connecting panels 2423, 2424.

Figure 8:
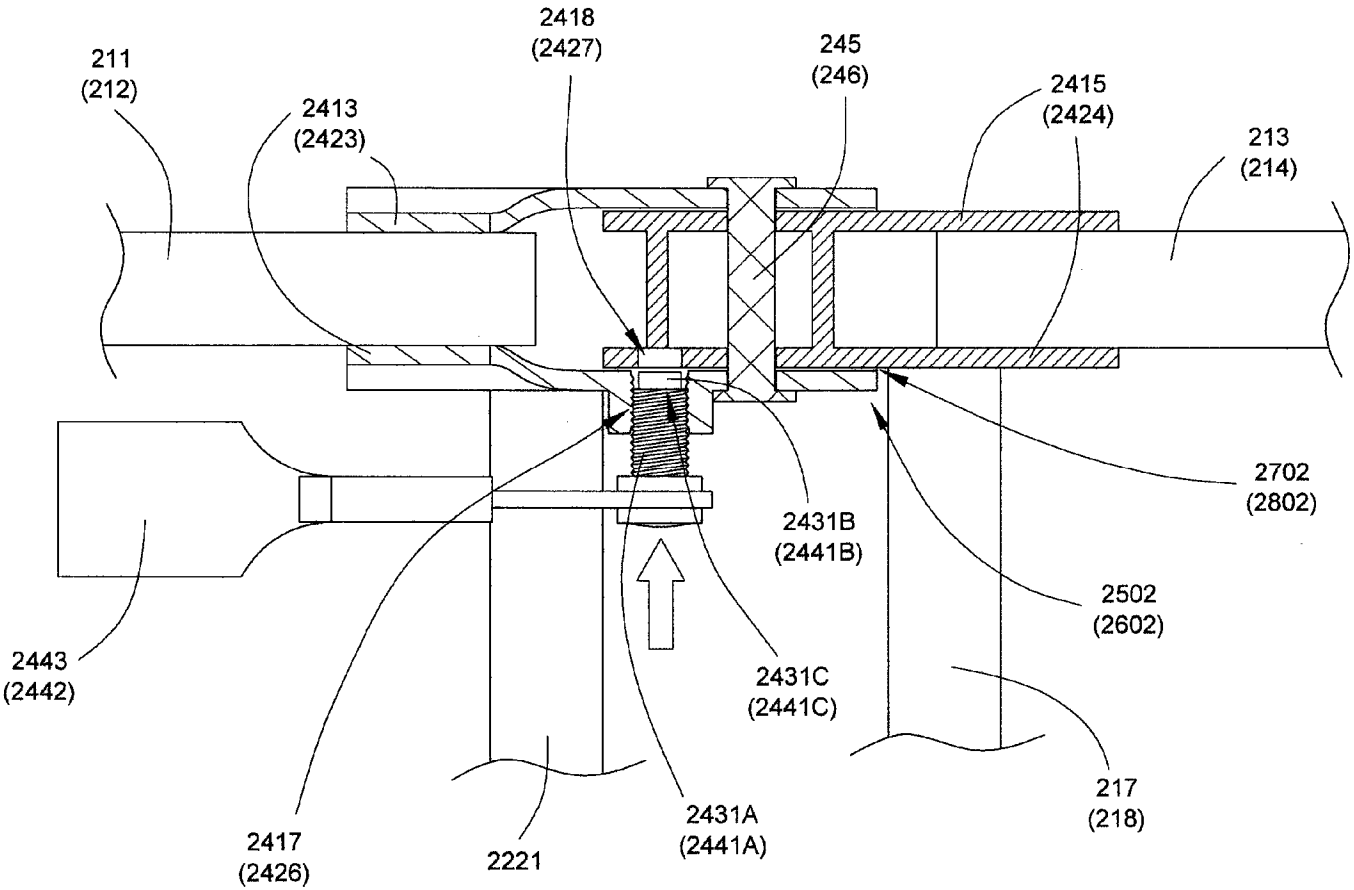
FIG. 8 illustrates a pivotal movable gap between the first and second connecting joints of the foldable table according to the above preferred embodiment of the present invention.

It is worth mentioning that the first and second connecting joints 241, 242 are symmetrical and the first and second locker devices 243, 244 are symmetrical. As shown in FIG. 8, in order to provide a pivotal movement, each of the first and second connecting joints 241, 242 has a pivotal movable gap for enabling a pivotal movement between the first and second tabletop panels 11, 12 to be pivotally folded between the folded condition and the unfolded condition. In fact, without any gap, two components, which are pivotally connected with each other, cannot be moved. Therefore, the movable gap must be inherently formed to enable the pivotal movement.

As shown in FIG. 8, the two third connecting panels 2415 are two inner connecting panels while the first connecting panels 2413 are two outer connecting panels, wherein the third connecting panels 2415 are located and overlapped between the first connecting panels 2413. The two first connecting panels 2413 are the first connecting panel with the first locker hole and the first connecting panel without the first locker hole respectively. The two third connecting panels 2415 are the third connecting panel with the third locker hole and the third connecting panel without the third locker hole respectively. The pivotal movable gap is formed between each of the first and third connecting panels 2413, 2415. In other words, the two pivotal movable gaps will enable the pivotal movement between the first and third connecting panels 2413, 2415.

When the first and second tabletop panels 11, 12 are folded at the folded condition, the first and third locker holes 2417, 2418 are not aligned with each other. Therefore, the first free end portion 2431C of the first locker pin 2413 cannot be inserted into the third locker hole 2418. Once the first and second tabletop panels 11, 12 are moved at the unfolded condition, the first and third locker holes 2417, 2418 are aligned with each other. Therefore, the first free end portion 2431C of the first locker pin 2413 can be inserted into the third locker hole 2418 when the first thread portion 2431A of the first locker pin 2431 is driven to rotate, as shown in FIG. 8.

Figure 9:
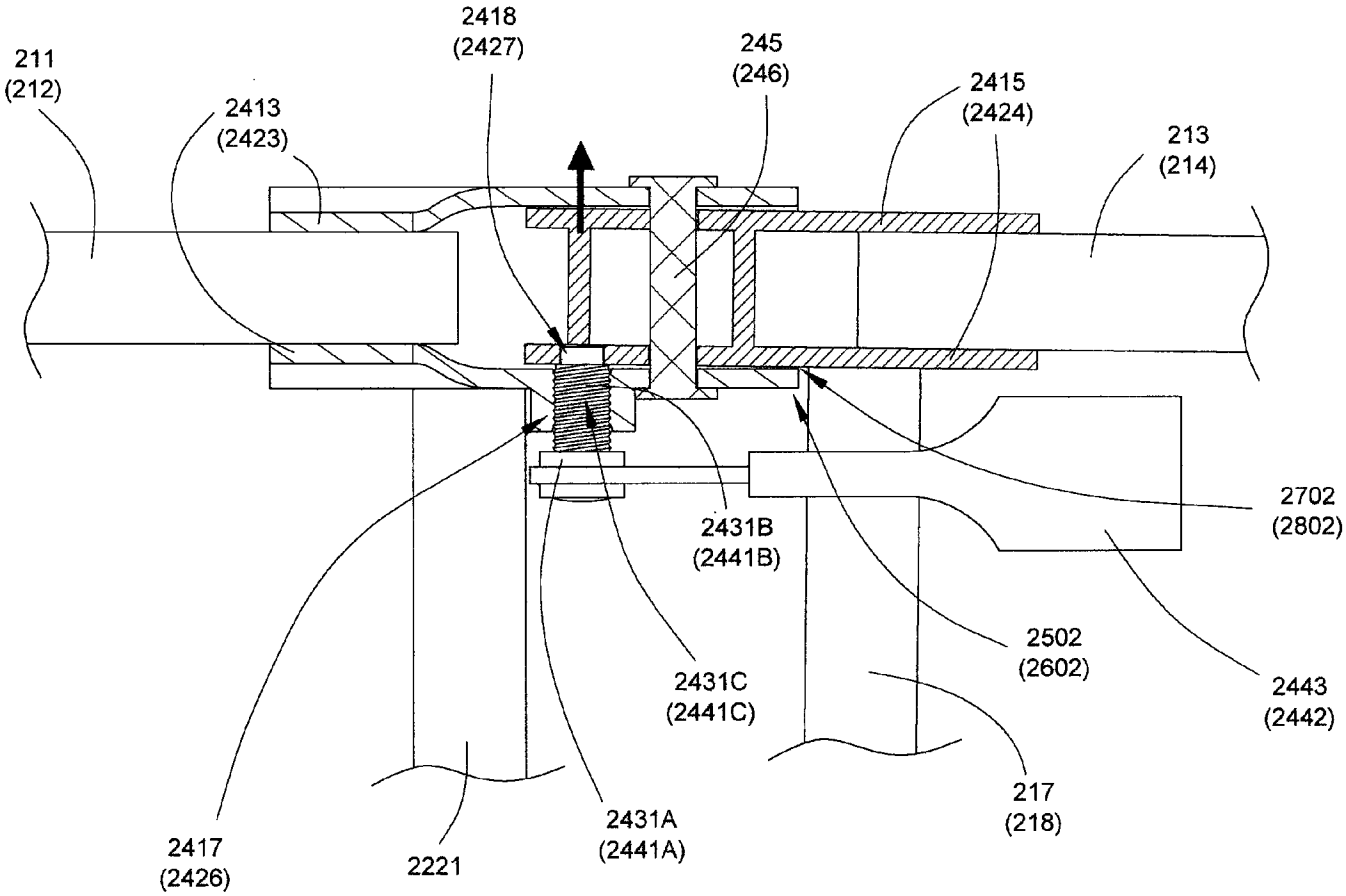
FIG. 9 illustrates the pivotal movable gap being minimized by the locking pin of the foldable table according to the above preferred embodiment of the present invention.

As shown in FIG. 9, the first locker pin 2431 is kept rotating until the first neck platform 2431C is biased against the corresponding third connecting panel 2415. The third connecting panel 2415 having the third locker hole 2418 will be pushed inwardly. As a result, the two third connecting panels 2415 will be slightly shifted to pivotally move with respect to the first pivot pin 245 and will be pushed toward the first connecting panel 2413 without the first locker hole. Due to the slightly pivotal movement of the third connecting panels 2415, the third connecting panel 2415 with the third locker hole will be pressed against the first connecting panel with the first locker hole as mentioned above i.e. the third neck portion 2702 of the third connecting panel 2415 with the third locker hole is pivotally moved to press against the corresponding first connecting panel 2413 with the first locker hole at the first free edge 2502 thereof. Therefore, the pivotal movable gap between the first connecting panel with the first locker hole and the third connecting panel 2415 with the third locker hole will be minimized. Furthermore, the third connecting panel 2415 without the third locker hole is pushed to press against the first connecting panel 2413 without the first locker hole, such that the pivotal movable gap between the third connecting panel 2415 without the third locker hole and the first connecting panel 2413 without the first locker hole will be minimized. As a result, the pivotal movable gap at the first connecting joint 241 will be minimized to prevent any unwanted lateral movement thereof which may cause the foldable table unstable.

Similarly, the two fourth connecting panels 2424 are two inner connecting panels while the second connecting panels 2423 are two outer connecting panels, wherein the fourth connecting panels 2424 are located and overlapped between the second connecting panels 2423. The two second connecting panels 2423 are the second connecting panel with the second locker hole and the second connecting panel without the second locker hole respectively. The two fourth connecting panels 2424 are the fourth connecting panel with the fourth locker hole and the fourth connecting panel without the fourth locker hole respectively. The pivotal movable gap is formed between each of the second and fourth connecting panels 2423, 2424. In other words, the two pivotal movable gaps will enable the pivotal movement between the second and fourth connecting panels 2423, 2424.

When the first and second tabletop panels 11, 12 are folded at the folded condition, the second and fourth locker holes 2426, 2427 are not aligned with each other. Therefore, the second free end portion 2441C of the second locker pin 2441 cannot be inserted into the fourth locker hole 2427. Once the first and second tabletop panels 11, 12 are moved at the unfolded condition, the second and fourth locker holes 2426, 2427 are aligned with each other. Therefore, the second free end portion 2441C of the second locker pin 2441 can be inserted into the fourth locker hole 2427 when the second thread portion 2441A of the second locker pin 2441 is driven to rotate, as shown in FIG. 8.

As shown in FIG. 9, the second locker pin 2441 is kept rotating until the second neck platform 2441C is biased against the corresponding fourth connecting panel 2424. The fourth connecting panel 2424 having the fourth locker hole will be pushed inwardly. As a result, the two fourth connecting panels 2424 will be slightly shifted to pivotally move with respect to the second pivot pin 246 and will be pushed toward the second connecting panel 2423 without the second locker hole. Due to the slightly pivotal movement of the fourth connecting panels 2424, the fourth connecting panel 2424 with the fourth locker hole will be pressed against the second connecting panel 2423 with the second locker hole as mentioned above i.e. the fourth neck portion 2802 of the fourth connecting panel 2424 with the fourth locker hole is pivotally moved to press against the corresponding second connecting panel 2423 with the second locker hole at the second free edge 2602 thereof. Therefore, the pivotal movable gap between the second connecting panel 2423 with the second locker hole and the fourth connecting panel 2424 with the fourth locker hole will be minimized. Furthermore, the fourth connecting panel 2424 without the third locker hole is pushed to press against the second connecting panel 2423 without the second locker hole, such that the pivotal movable gap between the fourth connecting panel 2424 without the fourth locker hole and the second connecting panel 2423 without the first locker hole will be minimized. As a result, the pivotal movable gap at the second connecting joint 242 will be minimized to prevent any unwanted lateral movement thereof which may cause the foldable table unstable.

Referring to FIG. 2 of the drawings, the tabletop 10 further comprises an engagement mechanism 15 provided on an inner side of the first and the second tabletop panel 11, 12 for facilitating easy folding and unfolding of the tabletop 10 while maintaining the stability thereof. More specifically, the engagement mechanism 15 comprises a first engaging member 151 and a second engaging member 152 provided on an inner side edge of the first tabletop panel 11 and the second tabletop panel 12 respectively, wherein the first engaging member 151 is arranged to be detachably engaged with the second engaging member 152.

Accordingly, by minimizing the gap at each of the first and second connecting joints 241, 242, and the gap at each of the first and second leg frames 22, 23, the entire structure of the reinforcing frame 21 will be substantially increased its rigidity. The loading capacity of the conventional foldable table is about 300 lb. The loading capacity of the foldable table of the present invention will increase to 1000 lb.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of folding up a table which comprises a first tabletop panel and a second tabletop panel, two leg frames foldably mounted at said first and second tabletop panels respectively, and two connecting joints pivotally coupled between said first and second tabletop panels for enabling said first and second tabletop panels to be pivotally folded between a folded condition and an unfolded condition, wherein a pivotal movable gap is formed at each of the connecting joints to enable a pivotal movement said first and second tabletop panels to be pivotally folded between said folded condition and said unfolded condition, wherein the method comprising the steps of:

(a) pivotally folding said first tabletop panel and said second tabletop panel to said unfolded condition; and (b) locking up the pivotal movement between said first and second tabletop panels in said unfolded condition by minimizing said pivotal movable gap of each of said connecting joints for preventing a lateral movement of each of said connecting joints through said pivotal movable gap thereof.

2. The method, as recited in claim 1, wherein each of said connecting joints comprises two joint members which are provided at said first and second tabletop panels respectively and are pivotally coupled with each other to define said pivotal movable gap between said two joint members, wherein the step (b) further comprise a step of engaging one of said joint members with and pressing against another said joint member to lock up said joint members and to minimize said pivotal movable gap between said joint members.

3. The method, as recited in claim 2, wherein said table further comprises two locker devices coupled at said connecting joints respectively adapted for being actuated to lock up the pivotal movement between said first and second tabletop panel in said unfolded condition, wherein each of said locker devices is rotatably coupled at one of said joint members.

4. The method, as recited in claim 3, wherein the step (b) further comprises a step of rotatably engaging a locker pin at a thread hole provided at one of said joint members and inserting into a locker hole provided at another said joint member, which is coaxially aligned with said thread hole when said first and second tabletop panels are moved in said unfolded condition, to lock up said joint members and to minimize said pivotal movable gap between said joint members.

5. The method, as recited in claim 3, wherein the step (b) further comprising a step of rotatably engaging a thread portion of a locker pin with a thread hole provided at one of said joint members and inserting a free end portion of said locker pin into a locker hole provided at another said joint member, which is coaxially aligned with said thread hole when said first and second tabletop panels are moved in said unfolded condition, to lock up said joint members and to minimize said pivotal movable gap between said joint members.

6. The method, as recited in claim 5, wherein a diameter of said thread portion of said locker pin is larger than a diameter of said free end portion of said locker pin to define a neck platform between said thread portion and said free end portion such that when said free end portion of said locker pin is inserted into said locker hole, said neck platform is pressed against said corresponding joint member.

7. The method, as recited in claim 6, wherein a length of said thread portion of said locker pin is longer than a length of said thread hole, such that after said free end portion of said locker pin is inserted into said locker hole, said locker pin is kept rotating until said neck platform thereof is biased against said corresponding joint member.

8. The method, as recited in claim 5, wherein a length of said thread portion of said locker pin is longer than a length of said thread hole, such that after said free end portion of said locker pin is inserted into said locker hole, said locker pin is kept rotating until said neck platform thereof is biased against said corresponding joint member.

9. The method, as recited in claim 2, wherein the step (b) further comprises a step of rotatably engaging a locker pin at a thread hole provided at one of said joint members and inserting into a locker hole provided at another said joint member, which is coaxially aligned with said thread hole when said first and second tabletop panels are moved in said unfolded condition, to lock up said joint members and to minimize said pivotal movable gap between said joint members.

10. The method, as recited in claim 9, further comprising the steps of: (c) affixing two retainers to two transverse members respectively, wherein said two transverse members transversely extended at two transverse sides of said first and second tabletop panels respectively; and (d) frictionally engaging said two retainers with two leg frames respectively, wherein said two leg frames are pivotally coupled at said two transverse members respectively, so as to minimize a rotatable gap formed between said leg frame and said transverse member to enable said leg frame to be pivotally moved with respect to said transverse member.

11. The method, as recited in claim 2, wherein the step (b) further comprising a step of rotatably engaging a thread portion of a locker pin with a thread hole provided at one of said joint members and inserting a free end portion of said locker pin into a locker hole provided at another said joint member, which is coaxially aligned with said thread hole when said first and second tabletop panels are moved in said unfolded condition, to lock up said joint members and to minimize said pivotal movable gap between said joint members.

12. The method, as recited in claim 11, wherein a diameter of said thread portion of said locker pin is larger than a diameter of said free end portion of said locker pin to define a neck platform between said thread portion and said free end portion such that when said free end portion of said locker pin is inserted into said locker hole, said neck platform is pressed against said corresponding joint member.

13. The method, as recited in claim 12, wherein a length of said thread portion of said locker pin is longer than a length of said thread hole, such that after said free end portion of said locker pin is inserted into said locker hole, said locker pin is kept rotating until said neck platform thereof is biased against said corresponding joint member.

14. The method, as recited in claim 12, further comprising the steps of: (c) affixing two retainers to two transverse members respectively, wherein said two transverse members transversely extended at two transverse sides of said first and second tabletop panels respectively; and (d) frictionally engaging said two retainers with two leg frames respectively, wherein said two leg frames are pivotally coupled at said two transverse members respectively, so as to minimize a rotatable gap formed between said leg frame and said transverse member to enable said leg frame to be pivotally moved with respect to said transverse member.

15. The method, as recited in claim 11, wherein a length of said thread portion of said locker pin is longer than a length of said thread hole, such that after said free end portion of said locker pin is inserted into said locker hole, said locker pin is kept rotating until said neck platform thereof is biased against said corresponding joint member.

16. The method, as recited in claim 15, further comprising the steps of: (c) affixing two retainers to two transverse members respectively, wherein said two transverse members transversely extended at two transverse sides of said first and second tabletop panels respectively; and (d) frictionally engaging said two retainers with two leg frames respectively, wherein said two leg frames are pivotally coupled at said two transverse members respectively, so as to minimize a rotatable gap formed between said leg frame and said transverse member to enable said leg frame to be pivotally moved with respect to said transverse member.

17. The method, as recited in claim 11, further comprising the steps of: (c) affixing two retainers to two transverse members respectively, wherein said two transverse members transversely extended at two transverse sides of said first and second tabletop panels respectively; and (d) frictionally engaging said two retainers with two leg frames respectively, wherein said two leg frames are pivotally coupled at said two transverse members respectively, so as to minimize a rotatable gap formed between said leg frame and said transverse member to enable said leg frame to be pivotally moved with respect to said transverse member.

18. The method, as recited in claim 2, further comprising the steps of: (c) affixing two retainers to two transverse members respectively, wherein said two transverse members transversely extended at two transverse sides of said first and second tabletop panels respectively; and (d) frictionally engaging said two retainers with two leg frames respectively, wherein said two leg frames are pivotally coupled at said two transverse members respectively, so as to minimize a rotatable gap formed between said leg frame and said transverse member to enable said leg frame to be pivotally moved with respect to said transverse member.

19. The method, as recited in claim 1, further comprising the steps of: (c) affixing two retainers to two transverse members respectively, wherein said two transverse members transversely extended at two transverse sides of said first and second tabletop panels respectively; and (d) frictionally engaging said two retainers with two leg frames respectively, wherein said two leg frames are pivotally coupled at said two transverse members respectively, so as to minimize a rotatable gap formed between said leg frame and said transverse member to enable said leg frame to be pivotally moved with respect to said transverse member.

* * * * *